US005604986A

United States Patent [19]

Masuda

[11] Patent Number: 5,604,986

[45] Date of Patent: Feb. 25, 1997

[54] ELECTRIC HAIR TRIMMER

[75] Inventor: Kesayuki Masuda, Matsumoto, Japan

[73] Assignee: Izumi Products Company, Nagano, Japan

[21] Appl. No.: 466,407

[22] Filed: Jun. 6, 1995

[30] Foreign Application Priority Data

Jan. 11, 1995 [JP] Japan ..... 7-002447

[51] Int. Cl.[6] ..... B26B 19/20

[52] U.S. Cl. ..... 30/233; 30/179

[58] Field of Search ..... 30/233, 233.5, 30/129, 286, 43.92

[56] References Cited

U.S. PATENT DOCUMENTS 4,776,095 10/1988 Tsujimoto et al. ..... 30/233

4,949,460 8/1990 Sterk ..... 30/233

5,084,974 2/1992 Sukow et al. ..... 30/233

*Primary Examiner*—Douglas D. Watts

*Attorney, Agent, or Firm*—Koda and Androlia

[57] ABSTRACT

An electric hair trimmer with a blade edge protective mechanism including a protective plate that is movable between two positions along movable and immovable blades so that the protective plate extends beyond the edges of the blades when the shutter plate is at one position thus hindering the exposure of the blade edges and retracts from the edges of the blade when the protective plate is at another position thus exposing the blade edges. The main switch of the trimmer is linked to the protective plate so that the operation of the main switch changes the position of the protective plate between two positions.

3 Claims, 7 Drawing Sheets

ELECTRIC HAIR TRIMMER

BACKGROUND OF THE INVENTION

1. Field of the Invention

The present invention relates to an electric hair trimmer.

2. Prior Art

FIGS. 11 and 12 show one conventional electric hair trimmer.

Reference numeral 102 is a main body case of the trimmer 100. A trimmer head 104 is provided on one end of the main body case 102, and a handle (not illustrated) is provided on the other end. A multiple number (two in this prior art) of engaging grooves 106 which are parallel to an immovable blade and a movable blade (described later) are formed on both side surfaces of the trimmer head 104.

The immovable blade 108 is installed in the trimmer head 104 so that the edge of the blade, which is formed into a sawtooth edge, protrudes from the upper surface of the trimmer head 104.

The movable blade 110 is installed on the immovable blade 108 so that the movable blade 110 performs a linear reciprocating motion in the left-right direction with respect to FIG. 11 while-the edge of the movable blade 110, which is formed as a sawtooth edge, slides against the edge of the immovable blade 108.

A comb attachment 112 is made of an elastically deformable material, e.g., a synthetic resin, etc., and is composed of two U-shaped members 114 positioned at a distance from each other that are connected at arm portions of the respective U-shaped members 114. In addition, a comb portion 116 which extends in the bending direction of the U-shaped members 14 is formed on the connected portion of the comb attachment 112. Furthermore, engaging projections 118 are formed on the inside surfaces of the tip ends of the arm portions of the U-shaped members 114.

The comb attachment 112 is attached to the trimmer head 104 in a detachable manner. In other words, the comb attachment 112 is pushed over the trimmer head 104 from the direction of the end of the trimmer head on which the immovable blade 108 and movable blade 110 are installed while spreading the arm portions of the respective U-shaped members 114, thus letting the engaging projections 118 of the attachment 112 engage with the engaging grooves 106 of the trimmer head 104. The comb attachment 12 can be removed from the trimmer head 104 by shifting it in the reverse direction from that described above.

In addition, by engaging the projections 118 with different engaging grooves 106, the position of the comb attachment 112 on the trimmer head 104 can be altered, so that the amount by which the comb portion 116 extends in the direction of protrusion of the immovable blade 108 and movable blade 110 from the trimmer head 104 (i.e., upward in FIGS. 11 and 12) can be varied.

The comb portion 116 brings hairs, which have acquired an certain "habit" or are lying flat, to the immovable blade 108 and movable blade 110. In addition, since the amount of protrusion of the comb portion 116 can be altered by selecting different attachment positions of the comb attachment 112, the comb portion 116 may change the height or length at which the hairs are cut.

However, the conventional electric hair trimmer as describe above has several problems.

First, when the hair is cut, the hair that is to be cut is combed with a comb and is then cut by applying the immovable and movable blades 108 and 110 (hereafter, collectively called "the blades") of the electric hair trimmer 100 to the desired cutting position. In some cases, however, it is necessary to make fine adjustments in the cutting position; and from the standpoint of operating efficiency, such adjustments would ordinarily be made by moving the electric hair trimmer 100 in vertical and lateral directions with the blades contacting the hair. However, if the cutting position is thus adjusted, the hair may be damaged by the blades. In such cases, it would be possible to lift the blades temporarily from the hair and then reapply the blades to the hair after changing the cutting position so that the hair is not damaged. If this is done, however, the operating efficiency drops compared to cases where the trimmer is moved while being in contact with the hair as described above.

Furthermore, in some cases, the comb portion 116 of the electric hair trimmer 100 is passed through the hair in order to confirm the cutting height after the attachment position of the comb attachment 112 has been altered. In such cases as well, the blades are brought into contact the hair so that the comb portion 116 does not pass smoothly through the hair. Accordingly, confirming the cutting height in this manner requires some effort; and since the hair is in contact with the blades, it is likely that the hair is easily damaged.

Furthermore, when the electric hair trimmer 100 is carried or set down with the comb attachment 112 removed, the blades could be damaged when they contact hard objects since the blades stick out from the trimmer head 104 and are not covered at all. Moreover, if the blades should contact the human body, it is obviously very dangerous.

SUMMARY OF THE INVENTION

Accordingly, the primary object of the present invention is to solve the problems with the prior art trimmers.

More specifically, the object of the present invention is to provide an electric hair trimmer which allows smooth trimming and other operations without damaging the hair during the adjustment of the cutting position and cutting height and also makes it possible to protect the blades of the trimmer.

The object of the present invention is accomplished by a unique structure for an electric hair trimmer that includes a main body case, a trimmer head formed at one end of the main body case, an immovable blade which is installed in the trimmer head so that the edge of the immovable blade, which is formed as a sawtooth edge, protrudes from the trimmer head, and a movable blade which is installed on the immovable blade so that the movable blade makes a linear reciprocating motion while the edge of the movable blade, which is formed as a sawtooth edge, slides against the edge of the immovable blade, and the unique structure of the present invention is that the trimmer head is provided with a shutter plate along the immovable blade and/or the movable blade so that the shutter plate can move between a first position and a second position in the direction of protrusion of the edge of the immovable blade, so that when the shutter plate is in the first position, the tip of the shutter plate protrudes beyond the edges of the immovable and movable blades, and when the shutter plate is in the second position, the tip of the shutter plate is retracted from the edges of the blades.

With the structure described above, when the shutter plate is set in the first position, damage to the hair that would be caused by the blades during adjustment of the cutting position is prevented, the immovable and movable blades are both protected, and injuries to the human body that would be caused by the blades are prevented.

In addition, the hair trimmer of the present invention may further include in the main body case a main switch, a driving means which causes the movable blade to make a linear reciprocating motion when the main switch is turned on, and a shutter-moving mechanism which causes the shutter plate to move into the second position only when the main switch is depressed. With this structure, the shutter plate can automatically move into the second position when the electric hair trimmer is in operation to cut the hair; and when the operation of the electric hair trimmer is stopped, the shutter plate automatically moves into the first position and stays in the first position. Accordingly, the hair cutting operation can be stopped instantly, so that excessive cutting of the hair is prevented.

With the shutter plate being capable of moving between the first and second positions in the direction of protrusion of the edge of the immovable blade, and with the tip of the shutter plate being set to protrude beyond the edges of the immovable and movable blades when the shutter plate has moved into the first position, damage to the hair that might be caused by the blades during the adjustment of the cutting position is prevented. In addition, the immovable and movable blades are both protected, and injuries to the human body by the blades can be prevented. Furthermore, when the shutter plate has been moved into the second position, the tip of the shutter plate does not protrude beyond the edges of the blades, and ordinary hair cutting can be performed.

DETAILED DESCRIPTION OF THE PREFERRED EMBODIMENT

Figure 1:
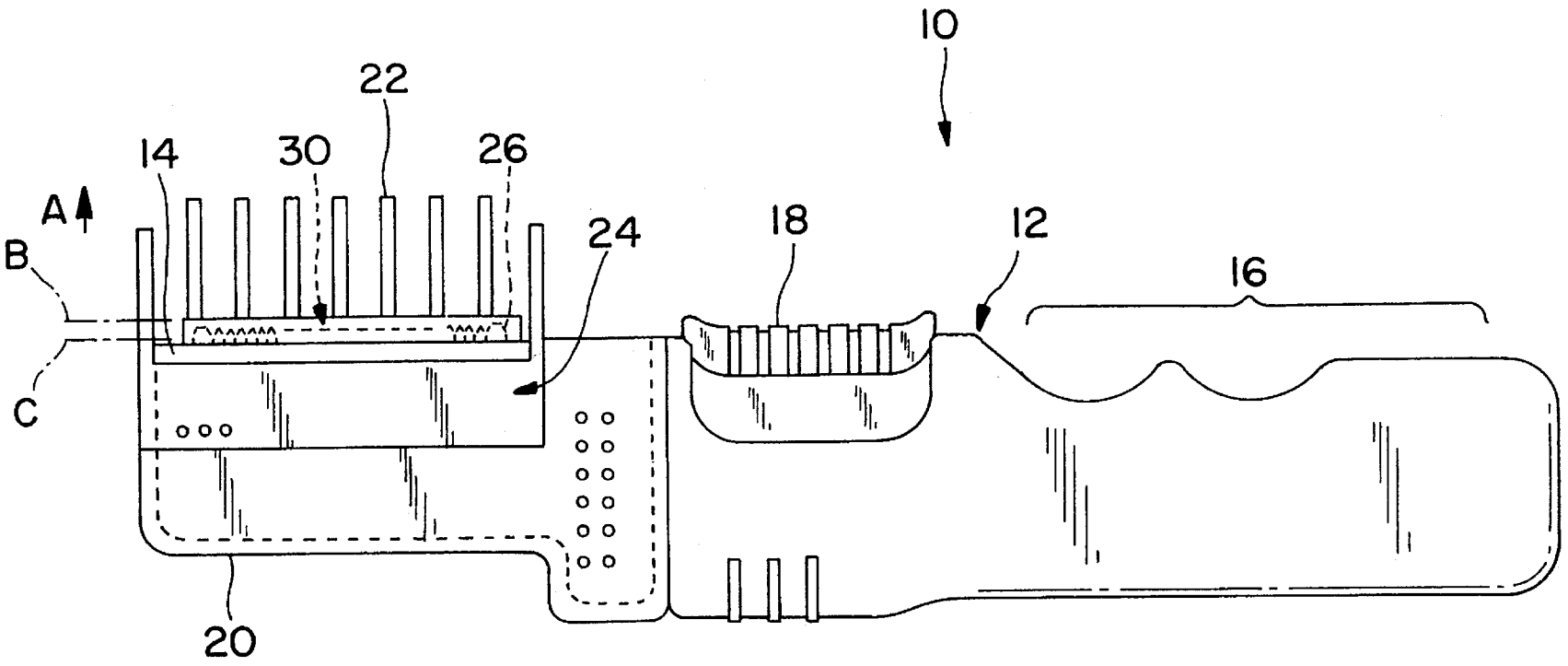
FIG. 1 is a front view of one of the embodiments of the electric hair trimmer according to the present invention.

The electric hair trimmer of the present invention is generally referred to by the reference numeral 10 in the Figures, and the trimmer 10 is comprised of a main body case 12 and a trimmer head 14.

The trimmer head 14 is formed at one end of the main body case 12 (i.e., the left end in FIG. 1), and a handle 16 is formed on the other end (i.e., the right end in FIG. 1). A main switch 18 of the type operated by being depressed is provided on the front side (which is upper side in FIG. 1) of the main body case 12. A sliding type switch could be used as the main switch 18 instead of the depression type switch. A head cover 20 and a comb attachment 24 on which a comb portion 22 is formed are attached to the trimmer head 14 in a detachable fashion.

The trimmer head 14 includes an immovable blade 26. The immovable blade 26 is installed on a first side surface **14*a* (called "front surface") of the trimmer head 14 so that the edge of the blade 26, which is formed as a sawtooth edge, protrudes from the front surface (upper surface in FIG. 1) of the trimmer head 14**.

The trimmer head further includes a movable blade 28. The movable blade 28 is installed on the front surface **14*a* of the trimmer head 14 so as to be along the immovable blade 26. The movable blade 28 can make a linear reciprocating motion in the left-right direction with respect to FIG. 1 so that the edge of the movable blade 28, which is formed as a sawtooth edge, slides against the edge of the immovable blade 26. The edge of the movable blade 28 also protrudes from the front surface (upper surface in FIG. 1) of the trimmer head 14**.

The trimmer head 14 further includes a shutter plate or protective plate 30 on the front surface **14*a*. The shutter plate 30 is in the shape of a plate made of a synthetic resin material, etc. and installed in the trimmer head 14 so as to lie along the immovable blade 26. The shutter plate 30 is installed so that it is positionally changeable between a first position B and a second position C in the direction of protrusion A of the edge of the immovable blade 26 as seen in FIG. 1**.

When the shutter plate 30 is in the first position B, the tip edge of the shutter plate 30 (the tip is formed as a straight line parallel to the direction of reciprocating motion of the movable blade 28) protrudes beyond the edges of the immovable and movable blades 26 and 28. When the shutter plate 30 is in the second position C, the tip of the shutter plate 30 is retracted from the edges of the two blades 26 and 28, so that the sawtooth edges of both of the immovable blade 26 and movable blade 28 protrude beyond the tip edge of the shutter plate 30.

In this embodiment, only one shutter plate 30 is used so as to be located along the immovable blade 26. However, the shutter plate 30 can be located along the movable blade 28. It is also possible to use two shutter plates 30 so that they are located on both sides of the blades, i.e., one along the immovable blade 26 and one along the movable blade 28.

The structures of the above-described components will be described in detail below.

Figure 2:
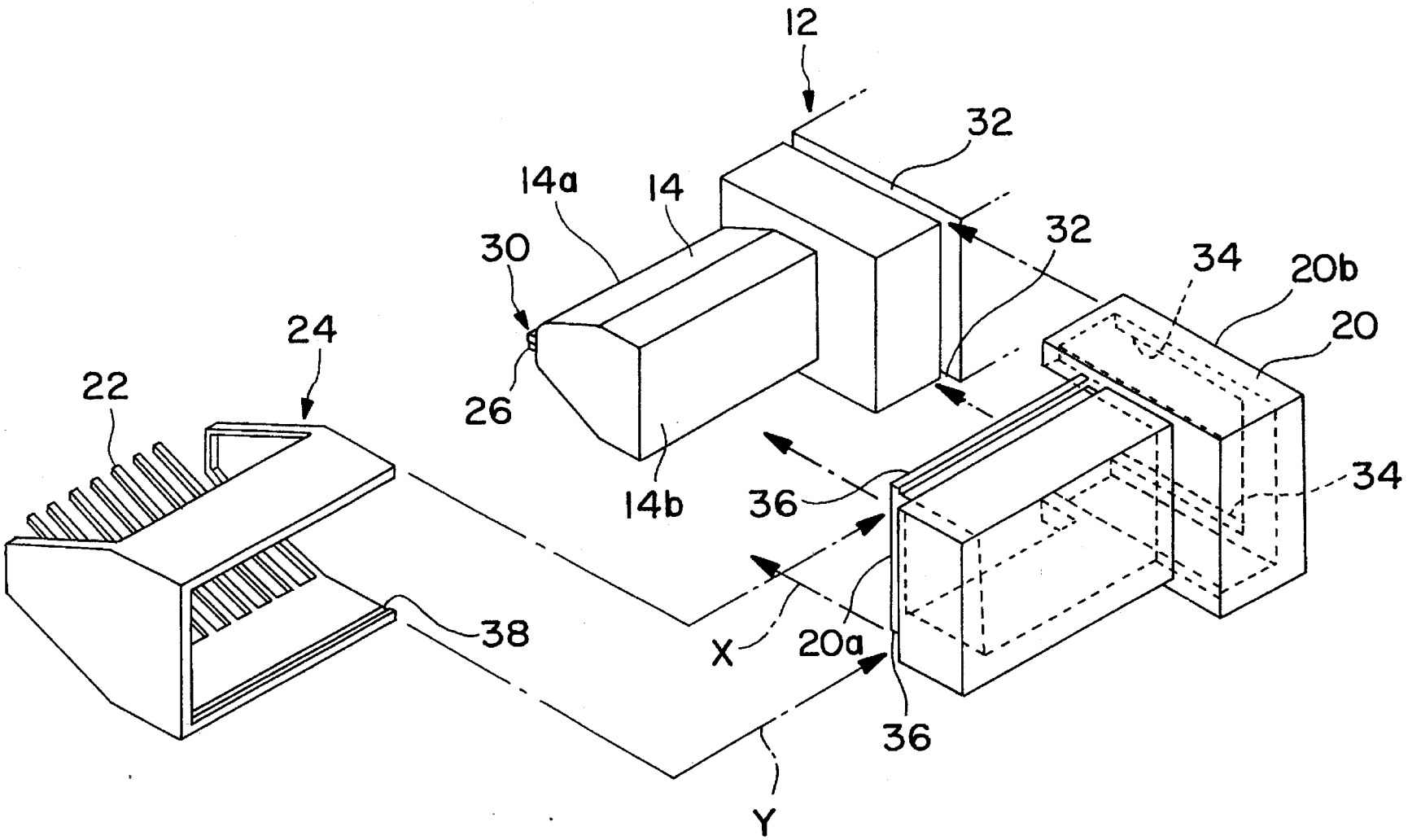
FIG. 2 is a perspective view of the structure and method of attachment of the head cover and comb attachment that are attached to the head portion of the electric hair trimmer of the present invention.

As shown in FIG. 2, a head cover 20 that is to be mounted on the trimmer head 14 is in a box shape which matches the external shape of the trimmer head 14. The head cover 20 is made of an elastically deformable material such as a synthetic resin, etc. and has a first opening (or front opening) 20*a* and a second opening (or bottom opening) 20*b*.

The head cover 20 is attached to the hair trimmer by first aligning the front opening 20*a* of the head cover 20 with the second side surface (or "rear surface") 14*b* of the trimmer head 14, and then moving the head cover 20 toward the front surface 14*a* of the trimmer head 14 so that the entire trimmer head 14 is covered by the head cover 20 except for the front side surface 14*a* of the trimmer head 14.

In this case, attaching of the head cover 20 on the trimmer head 14 is accomplished by letting first engaging projections 34 formed on the inside wall surfaces of the bottom opening 20*b* of the head cover 20 engage with first engaging grooves 32 formed on the main body case 12 between the trimmer head 14 and the main switch 18, and then moving the head cover 20 along the first engaging grooves 32 towards the front surface 14*a* of the trimmer head 14 as shown by arrow X.

Once the first engaging projections 34 have engaged with the first engaging grooves 32, the trimmer head 14 is clamped by the elastic force of the head cover 20, and the head cover 20 can be stopped at any desired position on the trimmer head 14 in the direction indicated by arrow X.

The head cover 20 is provided with a pair of second engaging projections 36 which are used to guide a comb attachment 24 in place on the head cover 20. These second engaging projections 36 are formed on the outside wall surfaces of the front opening 20*a* of the head cover 20.

The comb attachment 24 is made of an elastically deformable material such as a synthetic resin, etc., and it is in the shape of a box which is open on three sides (front, back and bottom) as best seen in FIG. 2. A pair of engaging grooves 38 are formed on the inside wall surfaces at one of the open sides (that is, the back side) of the comb attachment 24, and a comb 22 is formed on the other side (front side) that is opposite from the rear side. The opened bottom side of the comb attachment 24 is between the front and back open sides and is roughly the same shape as the shape of the end configuration of the trimmer head 14.

The comb attachment 24 is attached to the head cover 20. The bottom ends of the engaging grooves 38 of the comb attachment 24 are brought to engage with the top ends of the engaging projections 36 of the trimmer head 20, and then sliding the comb attachment 24 along the engaging projection 36 of the trimmer head 20 in the direction indicated by arrow Y.

The two components, the head cover 20 and the comb attachment 24, are mounted on the trimmer head 14 in an order such that the head cover 20 is first mounted on the trimmer head 14, and then the comb attachment 24 is attached to the head cover 20 as shown in FIG. 2.

Figure 3:
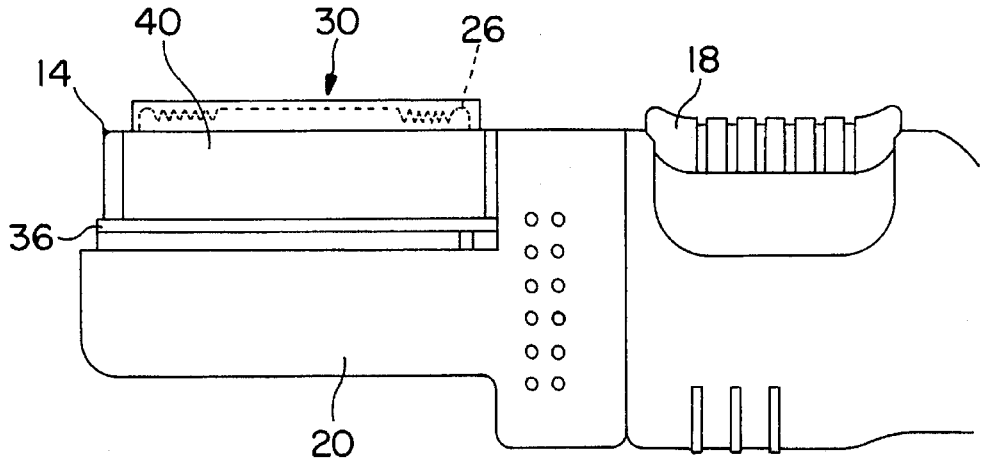
FIG. 3 is a top view of the trimmer head of the hair trimmer shown in FIG. 1, illustrating only the comb attachment removed from the trimmer head.
Figure 4:
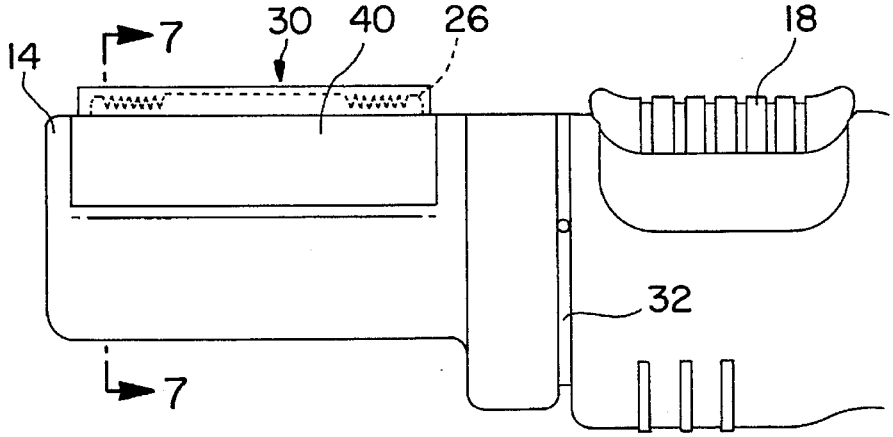
FIG. 4 is a top view of the trimmer head of the hair trimmer shown in FIG. 1, illustrating both the comb attachment and the head cover removed from the trimmer head.

When these two components are removed from the trimmer head 14, the comb attachment 24 is first removed from the head cover 20 (see FIG. 3), and then the head cover 20 is removed from the trimmer head 14 (see FIG. 4).

Next, the detail of the shutter plate 30 will be described below.

Figure 5:
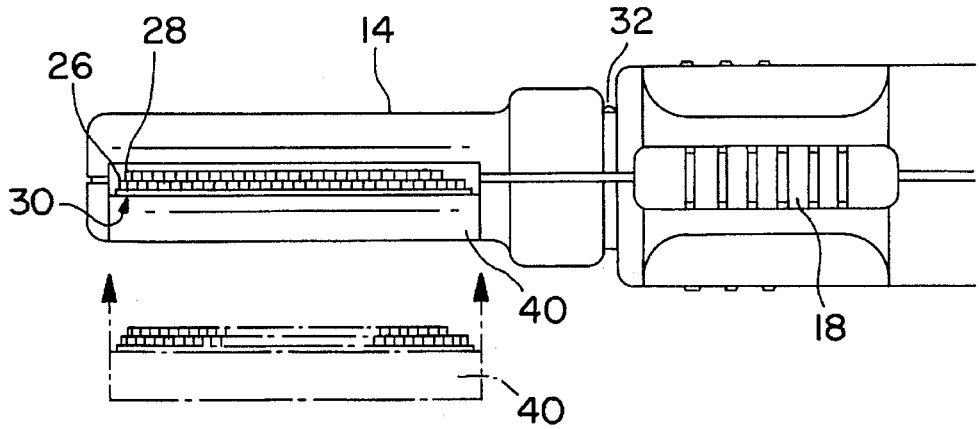
FIG. 5 is a side view of the trimmer head, particularly showing the attachment surface of the immovable blade shown in FIG. 4.
Figure 6:
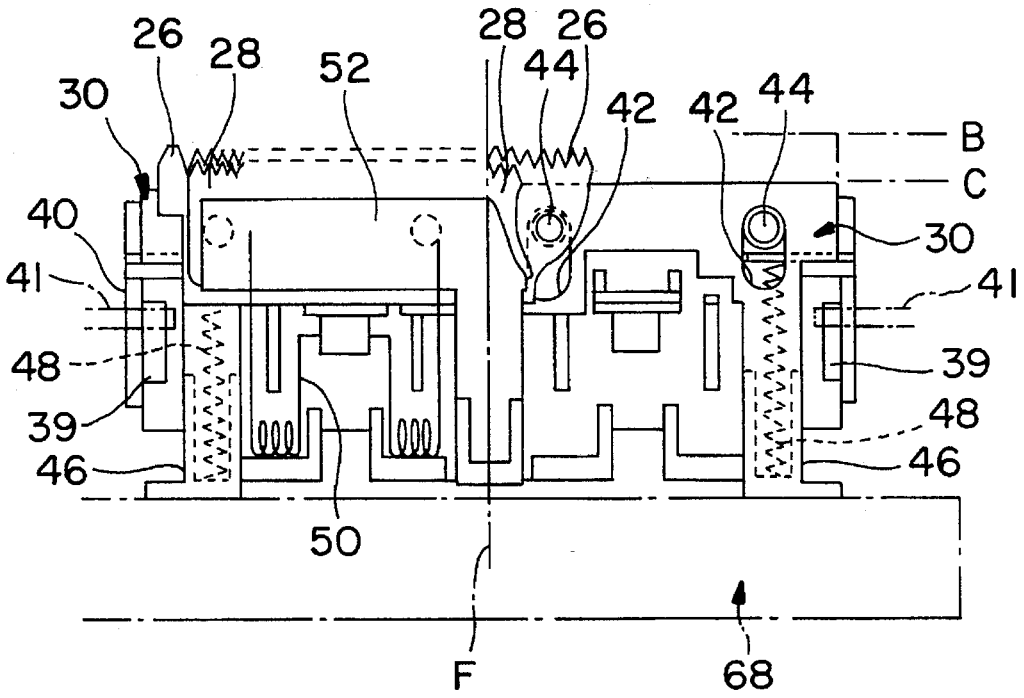
FIG. 6 is a partially cut-away front view of the essential portions of the blade case, illustrating the way to attach the components of the trimmer of the present invention (the immovable blade, movable blade, shutter plate, first driving members and second driving members) to the blade case.
Figure 7:
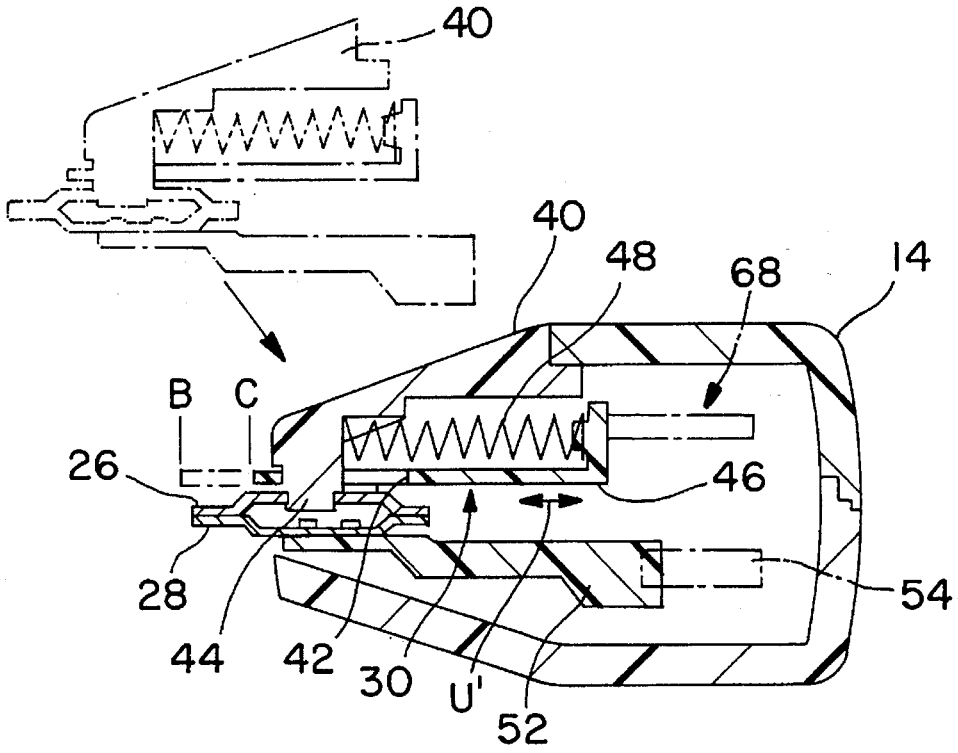
FIG. 7 is a sectional view taken along the line 7—7 in FIG. 4, illustrating the internal structure of the trimmer head.

As shown in FIGS. 5 and 7, the trimmer head 14 includes a blade case 40 which is detachable from the trimmer head 14. The immovable blade 26, movable blade 28 and shutter plate 30 are installed on the inside wall surfaces of this blade case 40. The blade case 40 is detachable from the trimmer head 14 so that hair debris which enters into the trimmer head 14 via the gaps between the immovable blade 26, movable blade 28 and shutter plate 30 during the hair cutting operation can be removed. Furthermore, as shown in FIG. 6, the blade case 40 is attached to the trimmer head 14 by causing hooks 39 formed on both side surfaces of the blade case 40 to engage with pins 41 formed on the inside wall of the trimmer head 14.

The structure of the blade case 40 in which the immovable blade 26, movable blade 28 and shutter plate 30 are installed will be described in detail along with the detailed structures of the blade case 40, immovable blade 26, movable blade 28 and shutter plate 30, using FIGS. 6 and 7. For the sake of example, the blade case 40, immovable blade 26, movable blade 28, shutter plate 30 and movable lever (described later) are all formed in shapes which show left-right symmetry with respect to the center line F in FIG. 6.

Guide slots 42 are opened in the shutter plate 30, and the shutter plate 30 is mounted on the back of the blade case 40 so that columnar projections 44 formed on the back are brought into the guide slots 42. In this embodiment, four guide slots are formed.

The shutter plate 30 is attached to the blade case 40 so that the shutter plate 30 is prevented from slipping out by the immovable blade 26, which is likewise fastened to the columnar projections 44 on top of the shutter plate 30. The shutter plate 30 attached to the blade case 40 can move up and down (in the left-right direction in FIG. 7) between the first position B and the second position C along the guide slots 42 which extend in the direction of protrusion of the immovable blade 26, with the amount of movement of the shutter plate 30 being restricted in the left-right direction in FIG. 6.

Furthermore, leg portions 46 facing in the opposite direction from the direction of the edge of the immovable blade 26 are formed to extend from the shutter plate 30; and first driving members 48, e.g., coil springs, plate springs, etc., are installed inside the leg portions 46 between the blade case 40 and the shutter plate 30, so that the shutter plate 30 is constantly urged toward the second position C with respect to the blade case 40.

The movable blade 28 is positioned on the immovable blade 26 so as to make a reciprocating motion in the left-right direction in FIG. 6 while the edge of the movable blade 28 slides against the edge of the immovable blade 26.

The movable blade 28 is integrally attached to the blade case 40 and is constantly urged toward the immovable blade 26 by second driving members 50, e.g., coil springs, plate springs, etc., which are installed in the blade case 40.

In addition, a movable lever 52 is attached to the movable blade 28. The movable lever 52 is driven by an electric motor (not illustrated) which is a part of the driving section and is caused to perform a linear reciprocating motion via a connecting area 54 (that is another part of the driving section) which reciprocates in the front-back directions as indicated by the arrow U' in FIG. 7. As a result, when the electric motor is turned on, the movable lever 52 and movable blade 28 make a continuous reciprocating motion in the left-right direction in FIG. 6. The electric motor is operated only when the main switch 18 is depressed.

The following structure is also possible: (a) the immovable blade 26, movable blade 28 and shutter plate 30 are installed in this order in the blade case 40, (b) a supporting member is installed on top of the shutter plate 30, (c) the second driving members 50 are installed between the blade case 40 and the supporting member and integrally attached to the blade case 40, and (d) the movable blade 28 reciprocates between the immovable blade 26 and the shutter plate 30. However, it is preferable to use the structure as described in detail above in which the shutter plate 30 is between the immovable blade 26 and the blade case 40, because this structure has a greater merit in that the number of components required is less, and the structure is simple.

Next, the shutter-moving mechanism will be described with reference to FIGS. 8 and 9. The shutter-moving mechanism is provided inside the main body case 12, and it connects the main switch 18 to the shutter plate 30 and moves the shutter plate 30 into the second position C only when the main switch 18 is depressed.

The shutter-moving mechanism is composed of the following components:

a. Third driving member 56 such as a coil spring, plate spring, etc. The third driving member 56 is provided between the main switch 18 and the main body case 12 and constantly urges the main switch 18 in the direction which causes the main switch 18 to protrude from the main body case 12 as shown by arrow U in FIG. 8. Furthermore, an anchoring part 58 which prevents the main switch 18 from slipping out of the main body case 12 is installed on the tip part of the main switch 18 inside the main body case 12.

b. A driving lever 60 in the shape of an "L". The driving lever 60 is coupled to the main body case 12 so that the lever can pivot about a rotating shaft D. A slot 62 is formed in one end part of the driving lever 60, and a connecting projection 66 of the main switch 18 is inserted in this slot 62. As a result, the driving lever 60 pivots when the main switch 18 is actuated.

c. A push-up lever 68 which is shaped in a long plate-form. A driving slot 70 into which the driving projection 64 is inserted is formed in one end of the lever 68. The slot 70 is oriented perpendicular to the direction of the length of the lever 68. In addition, moving slots 72 which extend at an oblique angle with respect to the direction of the length of the lever 69 are opened near both ends of the lever 68 (one slot at each end). The push-up lever 68 thus structured is installed inside the trimmer head 14 in a manner that two supporting projections 74 projecting from the inner wall surface of the trimmer head 14 are brought into two moving slots 72 of the lever 68 and the push-up lever 68 is capable of moving in the direction of the length of the moving slots 72 or in the direction of arrow Z in FIG. 8. One side surface (the upper surface in FIGS. 6, 8 and 9, the left-end surface in FIG. 7) of the push-up lever 68 is in contact with the leg portion 46 of the shutter plate 30 which is attached to the blade case 40.

d. A pair of fourth driving members 76 which are plate springs, coil springs, etc. These driving members 76 constantly urge the push-up lever 68 toward the shutter plate 30 or in the direction of arrow U. FIG. 8 shows that the embodiment uses plate springs 76, and the pressing force of the fourth driving members 76 are set so that it is stronger than that of the first driving member 48 which is provided between the shutter plate 30 and the blade case 40. Accordingly, the shutter plate 30 is constantly urged upward (in FIGS. 8 and 9 or along the arrow U) by the driving force of the fourth driving members 76 so that the shutter plate 30 is kept in the first position B.

Figure 9:
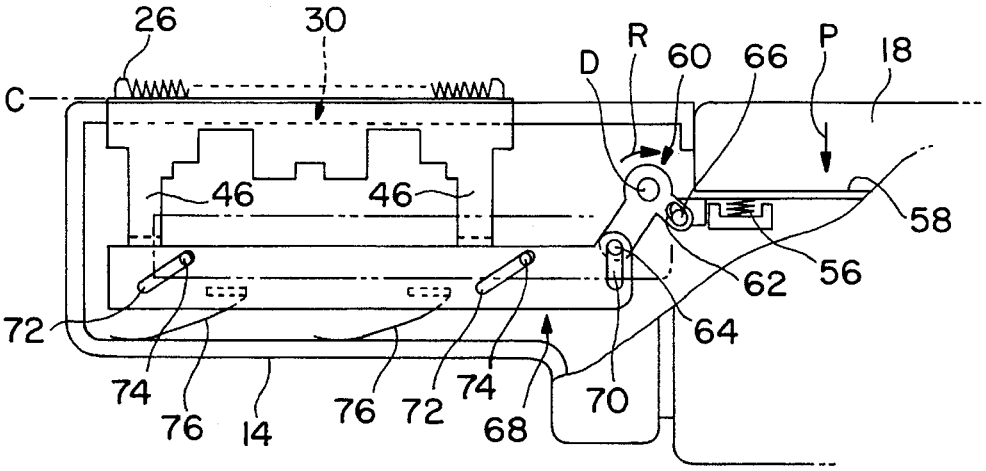
FIG. 9 is also a partially cut-away front view of the trimmer head which illustrates the structure of the shutter-moving mechanism of the trimmer of the present invention wherein the shutter plate is in the second position C.

When the push-up lever 68 is pushed downward in the direction of arrow P, the driving lever 60 rotates in the clockwise direction as shown by arrow R, so that the driving projection 64 of the driving lever 60 is moved to the left in FIG. 9. With the movement of this driving projection 64, the push-up lever 68 moves obliquely downward and to the left along the moving slots 72 against the driving force of the fourth driving members 76. Accordingly, the shutter plate 30 is moved into the second position C by the driving force of the first driving members 48.

When the main switch 18 is a sliding type switch and not a depressing type as described above, the same shutter-moving mechanism which moves the shutter plate 30 up and down in the Figures can be realized by means of a structure which is substantially the same as the structure described above.

The operation and method of use of the electric hair trimmer 10 will be described below.

First, the hair cutting height is set. The height setting is performed by changing the distance from the edge of the immovable blade 26 to the tip of the comb portion 22; in other words, it is done by moving the head cover 20 along the first engaging grooves 32 with the head cover 20 and the comb attachment 24 mounted on the trimmer head 14.

When the height setting has been done, the cutting height can be checked by actually passing the comb portion 22 through the hair without operating or depressing the main switch 18. In this case, the main switch 18, driving lever 60 and push-up lever 68 are in the positions shown in FIG. 8; and therefore, the shutter plate 30 is pushed by the push-up lever 68 so that the shutter plate 30 is in the first position B, that is, the shutter plate 30 is at the maximum protrusion position from the trimmer head 14. Thus, the tip end of the shutter plate 30 projects beyond the edges of the immovable blade 26 and movable blade 28, and the hair tends not to contact the edges of the immovable blade 26 nor movable blade 28. Thus, the hair passes easily through the comb portion 22, and the hair cutting height can be checked smoothly. Also, damage to the hair caused by the edges of the blades can be prevented during this checking operation.

When the hair is cut, the electric hair trimmer 10 is, with the main switch 18 "off" (i.e., not depressed), first moved by hand so that the trimmer head 14 contacts the hair while the hair is combed by the comb portion 22 or by means of a separate comb. Thus, the cutting position can be determined; and since the shutter plate 30 protrudes from the trimmer head 14 to a point beyond the edges of the immovable and movable blades, the hair does not come into direct contact with the blades. Therefore, even if the trimmer head 14 is moved to make fine adjustments in the cutting position, the hair will not be damaged by the blades. Furthermore, the trimmer head 14 can easily be moved obliquely and laterally with respect to the direction of the hair, so that the cutting position can be easily determined.

Next, the main switch 18 is depressed after the cutting position has been determined. When the main switch 18 is depressed, the driving lever 60 pivots in the clockwise direction (indicated by arrow R) as shown in FIG. 9, and the push-up lever 68 is moved obliquely downward and to the left. When the push-up lever 68 is thus moved downward as in FIG. 9, the shutter plate 30 that is in contact with the lever 68 is also moved downward so that the shutter plate 30 is positioned in the second position C, i.e., the position of maximum retraction into the trimmer head 14. Accordingly, the tip end of the shutter plate 30 is not positioned not beyond the edges of the immovable blade 26 and movable blade 28.

When the shutter plate 30 has been moved down as described above by pressing the switch 18, at roughly the same time (or with a slight delay) the electric motor is actuated by the depressed switch 18; and the connecting piece 54 begins to make a linear reciprocating motion, so that the movable blade 28 also makes a linear reciprocating motion along the immovable blade 26, thus cutting the hair.

Figure 8:
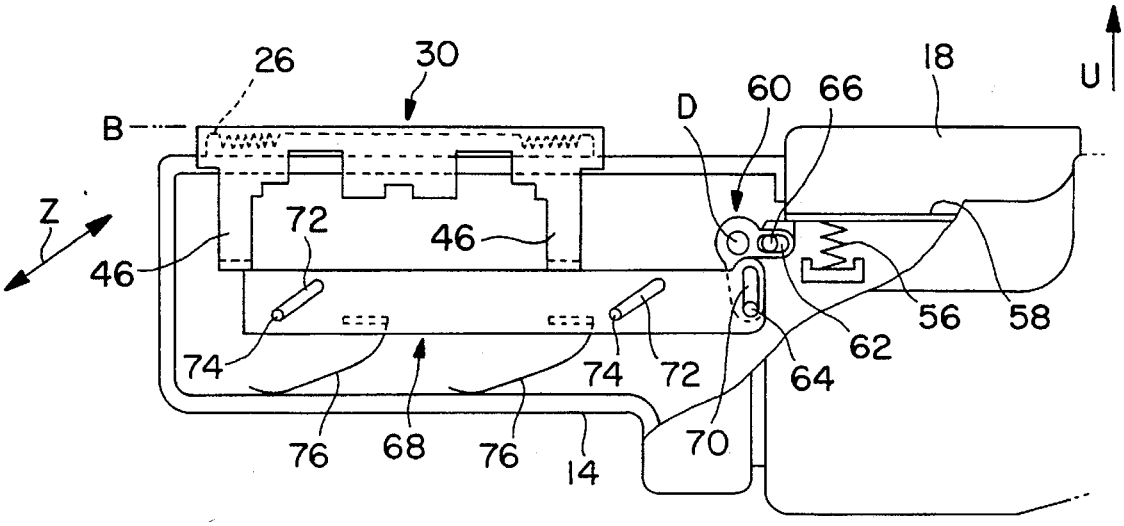
FIG. 8 is a partially cut-away front view of the trimmer head particularly showing the structure of the shutter-moving mechanism of the trimmer of the present invention wherein the shutter plate is in the first position B.

When the depression of the main switch 18 is released, the main switch 18 returns to its original position (i.e., the position shown in FIG. 8) by the spring 56, and the push-up lever 68 and shutter plate 30 simultaneously return to the positions shown in FIG. 8 as a result of the driving force of the fourth driving members 76. Accordingly, even if the complete stopping of the movable blade 28 is delayed as a result of inertial rotation of the electric motor that drives the movable blade 28 after the electric motor has been switched off, the hair cutting action of the immovable blade 26 and movable blade 28 can be immediately stopped.

Figure 10:
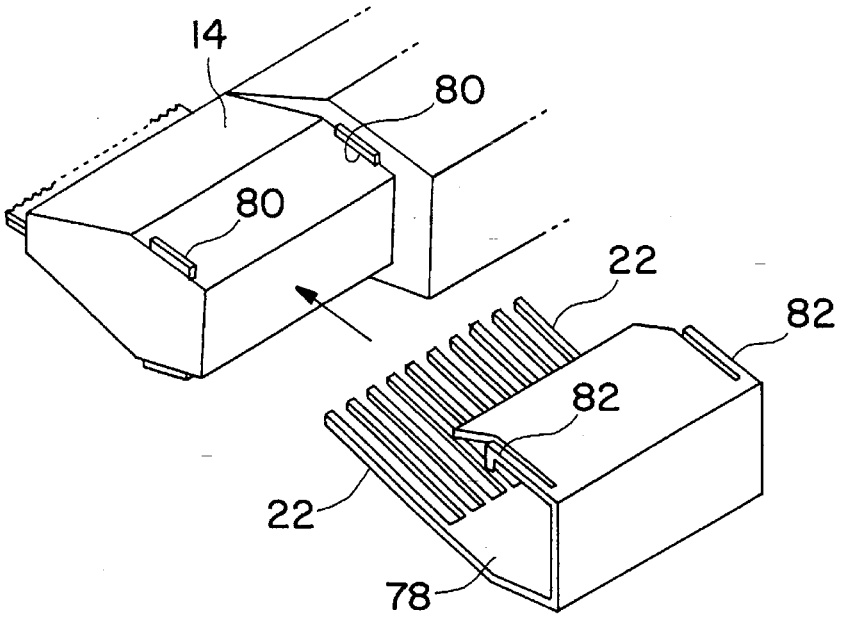
FIG. 10 is a perspective view of another embodiment of the comb attachment of the electric hair trimmer of the present invention.
Figure 11:
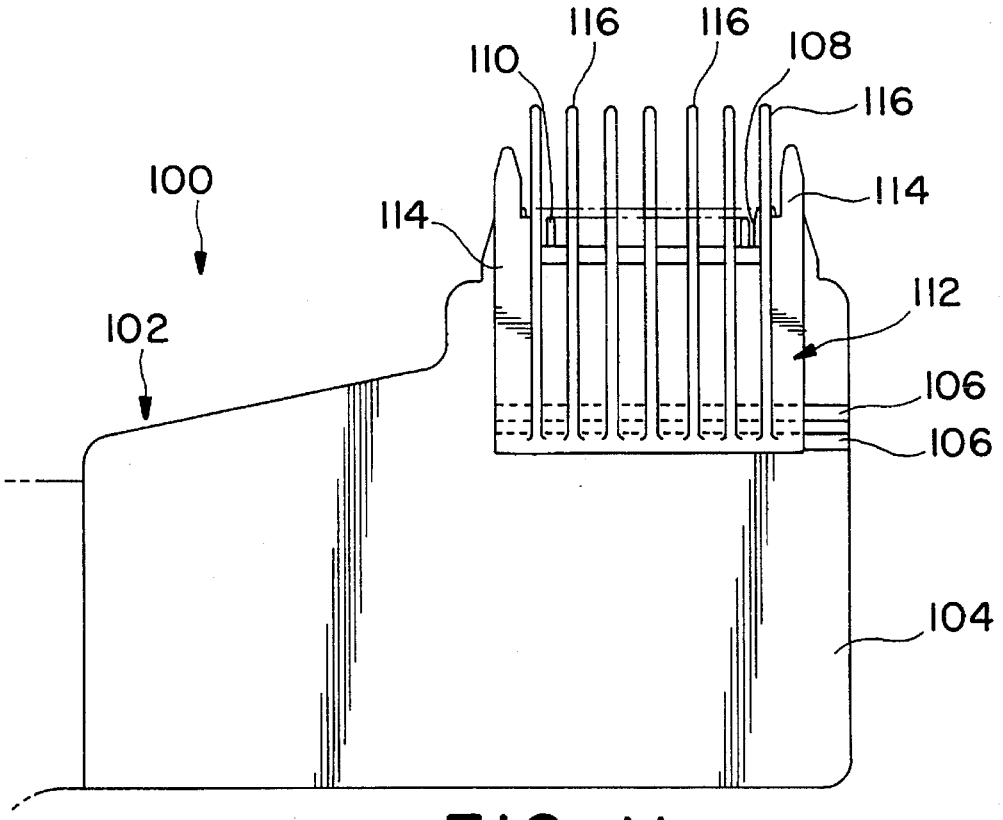
FIG. 11 PRIOR ART
FIG. 11 is a front view of the trimmer head and of the comb attachment attached to the trimmer head in one conventional electric hair trimmer.
Figure 12:
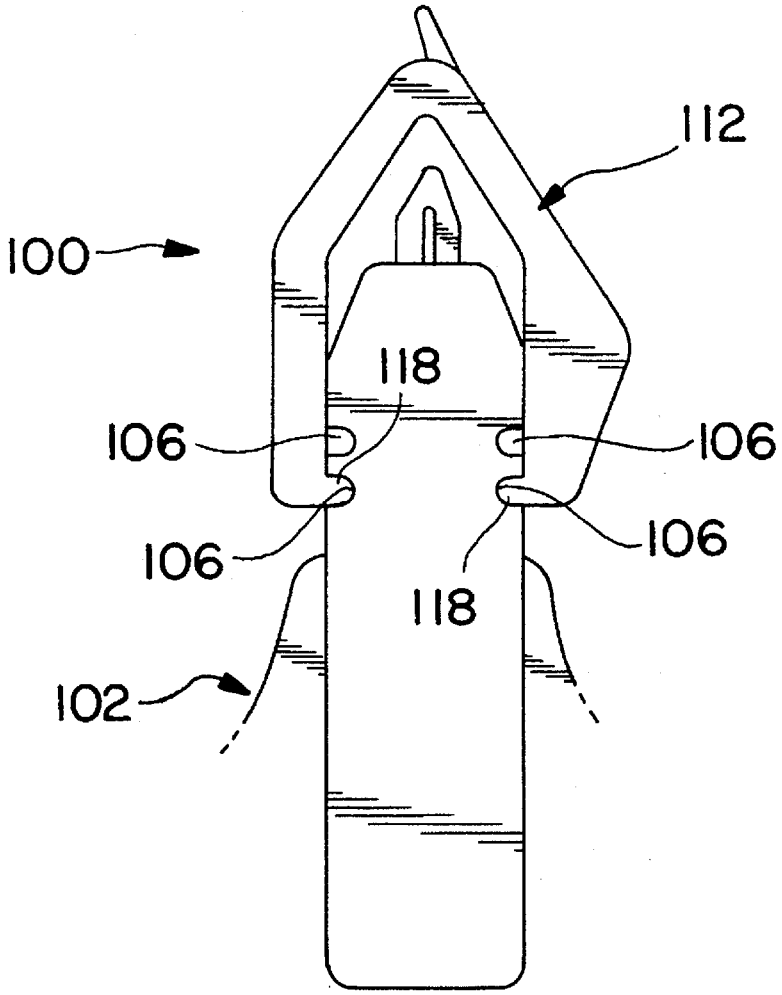
FIG. 12 PRIOR ART
FIG. 12 is a right-side view of the trimmer thereof.

In the present embodiment, the comb attachment 24 is attached to the trimmer head 14 by first attaching the head cover 20, and then attaching the attachment to the head cover 20. However, it is possible to form a comb attachment 78 having the shape shown in FIG. 10 and to attach such a comb attachment 78 directly to the trimmer head 14 without using a head cover 20. This comb attachment 78 is roughly U-shape in cross section, and the comb portion 22 is formed so as to extend from the tip of one of the arm portions of the U-shaped part. The comb attachment 78 can be mounted on the trimmer head 14 by fitting the comb attachment 78 over the trimmer head 14 from the side that is located on the opposite side of the trimmer head 14 from the side surface on which the immovable blade 26 is installed. With this structure, the number of components can be reduced, and a considerable reduction in cost is possible.

Furthermore, engaging tongues 82 which are capable of engaging with engaging ridges 80 formed on the trimmer head 14 are formed on the other arm portion of the comb attachment 78. With this structure, the comb attachment 78 is prevented from coming off after being attached to the trimmer head 14.

The hair trimmer of the present invention is described above in detail. However, the present invention is not limited to the embodiment above. It goes without saying that various modifications may be made without departing from the spirit of the present invention.

For example, the electric hair trimmer can be designed so that it uses no comb attachment. In this case, the shutter plate protects only the immovable and movable blades.

Furthermore, in the embodiment above, the movement of the shutter plate is accomplished by a linkage with the mechanical action of the main switch. However, it can be designed so that the main switch is used only as a source of electrical signal. In this case, an electric motor that actuates the shutter plate is employed so that the shutter plate is driven by actuating the electric motor so as to use the electrical signal as a trigger.

According to the present invention, a shutter plate or a protective plate is used in the trimmer head along the immovable blade and/or along the movable blade so that the shutter or protective plate is capable of moving between a first position and second position in the direction of protrusion of the edge of the immovable blade. In addition, when the shutter plate is in the first position, the tip of the shutter plate protrudes beyond the edges of the immovable and movable blades. Accordingly, when the trimmer head is placed against the hair, almost all of the hair contacts the shutter plate, so that damage to the hair caused by the blades of the electric hair trimmer is prevented during the fine adjustment of the cutting position.

In addition, the present invention is applicable to an electric hair trimmer to which a comb attachment with a comb portion is attached. In this case, the hair is likewise prevented from contacting the edges of the blades when the hair cutting height is checked by actually passing the comb portion through the hair after the hair cutting height has been set by altering the position of the comb attachment. Accordingly, the cutting height can be checked smoothly, and damage to the hair is prevented. Moreover, since the immovable blade and the movable blade are protected by the shutter plate, injuries to the human body that might be caused by the blades can be prevented.

With a shutter-driving mechanism which connects the shutter plate or protective plate to the main switch, the shutter or protective plate automatically moves into the second position when the main switch is depressed so that the electric hair trimmer is operated during hair cutting. Likewise, when the main switch is let up so that the cutting action of the electric hair trimmer is stopped, the shutter or protective plate automatically moves into the first position. Thus, the operating efficiency of the cutting position and cutting height setting operations and the hair cutting operation are highly improved.

I claim:

1. An electric hair trimmer comprising a trimmer head formed at one end of a main body case of said trimmer, an immovable blade installed on the trimmer head such that an edge of said immovable blade protrudes from said trimmer head, said edge of said immovable blade being formed as a sawtooth; a movable blade which is installed on said immovable blade such that said movable blade is linearly reciprocatingly movable relative to said immovable blade, an edge of said movable blade being formed as a sawtooth and slides against said edge of said immovable blade, and a means for linearly reciprocating said movable blade; and said trimmer being characterized in that a shutter plate which is capable of moving between a first position and a second position in a direction of protrusion of said edge of said immovable blade is installed in said trimmer head along said immovable and movable blades, so that when said shutter plate has been moved into said first position, a tip of said shutter plate protrudes beyond said edges of said immovable blade and movable blade from said trimmer head, and when said shutter plate has been moved into said second position, said tip of said shutter plate is retracted from said edges of said immovable and movable blades.

2. An electric hair trimmer according to claim 1 characterized in that said main body case is provided with:

a main switch;

said means for linearly reciprocating which causes said movable blade to make a linear reciprocating motion when said main switch is depressed, and a shutter-moving mechanism which causes said shutter plate to move into said second position only when said main switch is depressed.

3. An electric hair trimmer comprising:

a main body case;

a trimmer head formed at one end of said main body case of said trimmer;

an immovable blade installed on said trimmer head so that an edge of said immovable blade protrudes from said trimmer head;

a movable blade installed next to said immovable blade so that an edge of said movable blade protrudes from said trimmer head and said movable blade is reciprocatable to slide against said immovable blade;

a means for reciprocating said movable blade;

a protection plate provided in said trimmer head so as to be next to one of said immovable and movable blades, said protection plate being capable of moving between a first position and a second position so that when said protection plate is in said first position, an edge of said protection plate protrudes beyond said edges of said immovable and movable blades and when said protection plate is in said second position, said edge of said protection plate is retracted from said edges of said immovable and movable blades; and a main switch which is provided on said main body case and connected to a power source that activate said means for reciprocating so that said movable blade reciprocates, said main switch being further linked to said protection plate so that said protection plate is moved from said first position to said second position when said main switch is switched on to activate said means for reciprocating and said protection plate is moved from said second position to said first position when said main switch is switched off to inactivate said means for reciprocating.

* * * * *